US009226057B1

(12) United States Patent
Davis et al.

(10) Patent No.: US 9,226,057 B1
(45) Date of Patent: Dec. 29, 2015

(54) EXTERNAL SOUND SYSTEMS WITH INTEGRAL FLAT PANEL LOUDSPEAKERS FOR PORTABLE ELECTRONIC DEVICES

(71) Applicants: Gregg M. Davis, Powell, OH (US); Mark Edwards, Livermore, CA (US); Adam Hensel, Reynoldsburg, OH (US); Timothy A. Friar, Sunbury, OH (US)

(72) Inventors: Gregg M. Davis, Powell, OH (US); Mark Edwards, Livermore, CA (US); Adam Hensel, Reynoldsburg, OH (US); Timothy A. Friar, Sunbury, OH (US)

(73) Assignee: OIO Tech Inc., Powell, OH (US)

( * ) Notice: Subject to any disclaimer, the term of this patent is extended or adjusted under 35 U.S.C. 154(b) by 0 days.

(21) Appl. No.: 14/330,258

(22) Filed: Jul. 14, 2014

Related U.S. Application Data

(60) Provisional application No. 61/993,352, filed on May 15, 2014.

(51) Int. Cl.
*H04R 1/02* (2006.01)
*H04R 7/04* (2006.01)

(52) U.S. Cl.
CPC ..... *H04R 1/026* (2013.01); *H04R 1/025* (2013.01); *H04R 1/028* (2013.01); *H04R 7/04* (2013.01); *H04R 2400/11* (2013.01); *H04R 2499/11* (2013.01); *H04R 2499/15* (2013.01)

(58) Field of Classification Search
CPC ..... H04R 2499/15; H04R 5/02; H04R 1/24; H04R 7/045; H04R 7/06; H04R 17/00; H04R 1/021
USPC ..... 381/332
See application file for complete search history.

(56) References Cited

U.S. PATENT DOCUMENTS

| | | | | |
|---|---|---|---|---|
| 6,043,976 | A * | 3/2000 | Su | G06F 1/1632 361/679.41 |
| 6,201,878 | B1 | 3/2001 | Azima et al. | |
| 6,243,473 | B1 | 6/2001 | Azima et al. | |
| 6,324,052 | B1 | 11/2001 | Azima et al. | |
| 6,526,142 | B1 | 2/2003 | Fan | |
| 6,600,827 | B2 | 7/2003 | Lu | |
| 8,180,095 | B2 * | 5/2012 | Zhang | H04R 1/025 381/334 |
| 8,256,568 | B2 | 9/2012 | Lin | |
| D670,911 | S | 11/2012 | Bollinger et al. | |
| 9,002,050 | B2 * | 4/2015 | Widner | H04R 5/02 381/300 |

(Continued)

FOREIGN PATENT DOCUMENTS

WO WO 2012/112790 A2 8/2012

*Primary Examiner* — Mark Blouin
(74) *Attorney, Agent, or Firm* — Porter, Wright, Morris & Arthur, LLP

(57) ABSTRACT

An external sound system for a portable electronic device includes a mount configured to be secured to the portable electronic device, at least one sound panel coupled to the mount to selectively move between storage and operational positions relative to the portable electronic device, and at least one flat panel loudspeaker. The flat panel loudspeaker forms a portion of an exterior surface of the sound panel and is operably coupled to the portable electronic device to selectively produce sound. The sound panel can include a frame. The flat panel loudspeaker can include a vibratable panel having inner and outer surfaces, an exciter fixed to the frame and coupled to the inner surface of the vibratable panel to selectively impart vibrations to the vibratable panel, and a flexible support sheet secured to the outer surface of the vibratable panel and coupled to the frame to partially support the vibratable panel.

18 Claims, 11 Drawing Sheets

(56) References Cited

U.S. PATENT DOCUMENTS

2003/0063765 A1* 4/2003 Lu ..... G06F 1/1605 381/333
2006/0269091 A1 11/2006 Fan
2011/0235847 A1* 9/2011 Bhutani ..... H04R 5/02 381/395
2013/0083953 A1* 4/2013 Chang ..... G06F 1/1628 381/333
2013/0177181 A1 7/2013 Marcus

* cited by examiner

EXTERNAL SOUND SYSTEMS WITH INTEGRAL FLAT PANEL LOUDSPEAKERS FOR PORTABLE ELECTRONIC DEVICES

CROSS-REFERENCE TO RELATED APPLICATIONS

This application claims the priority benefit of U.S. Provisional Patent Application No. 61/993,352 filed on May 15, 2014, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to sound systems and, more particularly, to external sound systems for portable electronic devices.

BACKGROUND OF THE INVENTION

Portable electronic devices such as, for example, tablet computers, smart phones, and the like, have become very popular products. They are popular, at least in part, because they are very compact and thus very portable. The compact nature of these devices, however, also results in embedded speakers that provide poor sound quality. Typically, the portable electronic devices are unable to produce sound levels above 25 decibels at one meter. As a result, numerous wireless and wired speaker products are now available on the market for use with these portable electronic devices. Some of these external speakers are designed to rest on a table top, some are designed to be fastened to a wall, and others are designed to be clipped onto all kinds of things including the portable electronic devices themselves. While some of these external speaker products may produce sound of a much higher quality than the internal speakers, they negatively impact the very portable nature of the portable electronic devices which made them popular in the first place. No one wants to lug bulky external speakers around along with their portable electronic device.

Protective cases or covers are often used with portable electronic devices that are designed to provide protection for the devices from impact and from wear on external surfaces of the device including electronic display screens. One solution to the poor sound quality problem has been to integrate external speakers into protective covers for the portable electronic devices. For example, see U.S. Pat. Nos. 6,526,142, 6,600,827, 8,256,568, and D670,911 S, U.S. Patent Application Publication Number 2006/0269091 A1, and International Publication Number WO 2012/112790 A2, the disclosures of which are expressly incorporated herein in their entireties by reference. While these protective covers with integral external speakers may produce sound of a higher quality than the internal speakers and may be easier to transport than separate external speakers, they still negatively impact the very portable nature of the portable electronic devices which make them popular in the first place because the resulting protective covers are relatively large and bulky.

Accordingly, there is a need for more compact external sound systems for portable electronic devices.

SUMMARY OF THE INVENTION

Disclosed are more compact external sound systems for portable electronic devices which address one or more issues of the related art discussed above. Disclosed is an external sound system for a portable electronic device having an electronic display screen. The external sound system comprises, in combination, a mount configured to be secured to the portable electronic device, at least one sound panel coupled to the mount and selectively movable relative to the mount between at least a first position and second position, and at least one flat panel loudspeaker forming at least a portion of an exterior surface of the sound panel and operably coupled to the portable electronic device to selectively produce sound. The at least one sound panel is configured so that the at least one flat panel loudspeaker faces and at least partially covers the electronic display screen of the portable electronic device to protect the electronic display screen of the portable electronic device when the sound panel is in the first position and so that the at least one flat panel loudspeaker is located laterally beside the electronic display screen of the portable electronic device and faces in the same direction as the electronic display screen of the portable electronic device when the sound panel is in the second position.

Also disclosed is an external sound system for a portable electronic device having an electronic display screen wherein the external sound system comprises, in combination, a housing configured to hold the portable electronic device, at least one sound panel coupled to the housing and selectively movable relative to the housing to between at least a first position and a second position, and at least one flat panel loudspeaker forming at least a portion of an exterior surface of the at least sound panel and operably coupled to the portable electronic device to selectively produce sound. The at least one sound panel is configured so that the at least one flat panel loudspeaker faces and at least partially covers the electronic display screen of the portable electronic device to protect the electronic display screen of the portable electronic device when the sound panel is in the first position and so that the at least one flat panel loudspeaker is located laterally beside the electronic display screen of the portable electronic device and faces in the same direction as the electronic display screen of the portable electronic device when the sound panel is in the second position.

Also disclosed is a protective cover for a portable electronic device having an electronic display screen. The protective cover comprises, in combination, a housing configured to hold the portable electronic device, first and second sound panels pivotally coupled to the housing on opposed sides of the housing and selectively pivotal relative to the housing to cover and uncover the electronic display screen of the portable electronic device, a first flat panel loudspeaker forming at least a portion of an exterior surface of the first sound panel and operably coupled to the portable electronic device to selectively produce sound, and a second flat panel loudspeaker forming at least a portion of an exterior surface of the second sound panel and operably coupled to the portable electronic device to selectively produce sound. The first and second sound panels each include a frame. The first and second flat panel loudspeakers each include a vibratable panel having inner and outer surfaces, an exciter fixed to the frame and secured to the inner surface of the vibratable panel to selectively impart vibrations to the vibratable panel, and a flexible sheet secured to the outer surface of the vibratable panel and coupled to the frame to partially support the vibratable panel.

From the foregoing disclosure and the following more detailed description of various preferred embodiments it will be apparent to those skilled in the art that the present invention provides a significant advance in the technology and art of external sound systems for portable electronic devices. Particularly significant in this regard is the potential the invention affords for providing relatively lightweight, compact, versatile, and easy to use external sound systems for portable electronic devices which greatly improve sound quality without adversely impacting the compactness and portability of the portable electronic devices. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
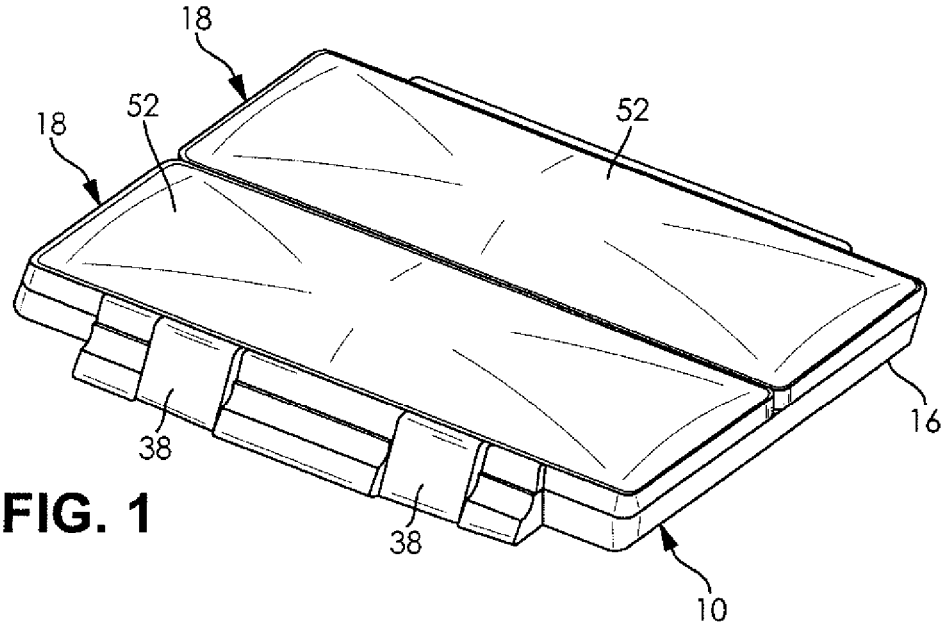
FIG. 1 is a front perspective view of a protective cover on a portable electronic device according to a first embodiment of the present invention, wherein first and second sound panels, each having a flat panel loudspeaker, are in a first or storage position located in front of an electronic display screen of the portable electronic device with the flat panel loud speakers facing rearward toward the electronic display screen so that the sound panels are covering the electronic display screen of the portable electronic device to protect the electronic display screen of the portable electronic device.
Figure 2:
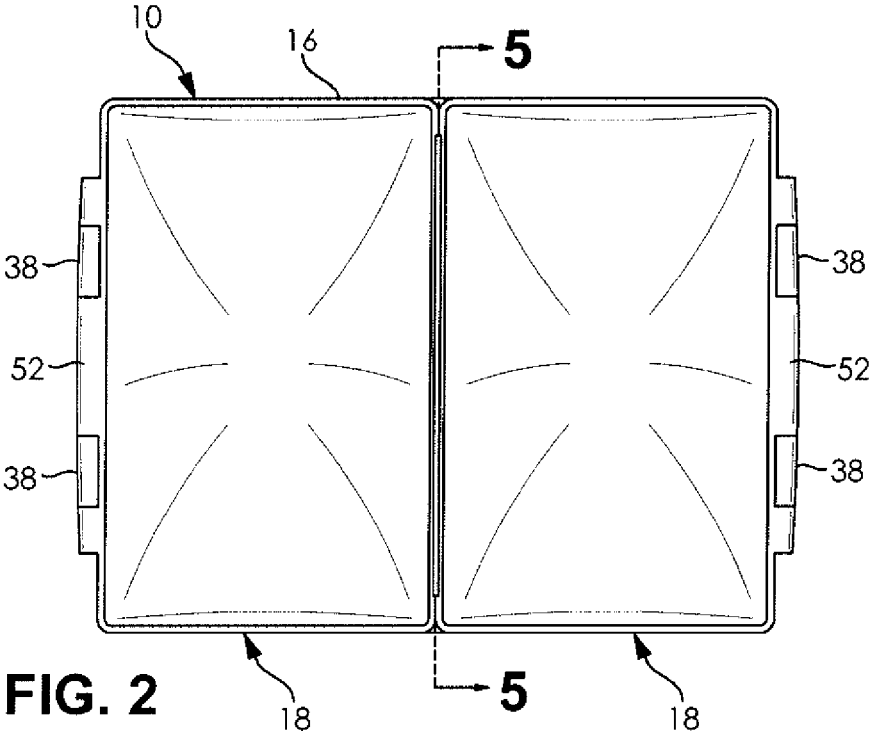
FIG. 2 is a front elevational view of the protective cover and the portable electronic device of FIG. 1.
Figure 3:
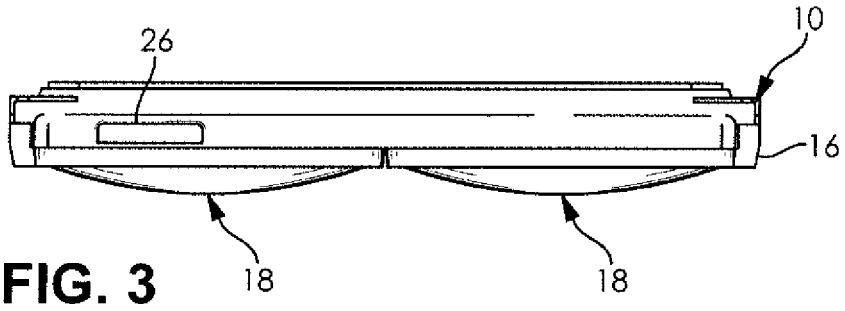
FIG. 3 is a top plan view of the protective cover and the portable electronic device of FIGS. 1 and 2.
Figure 4:
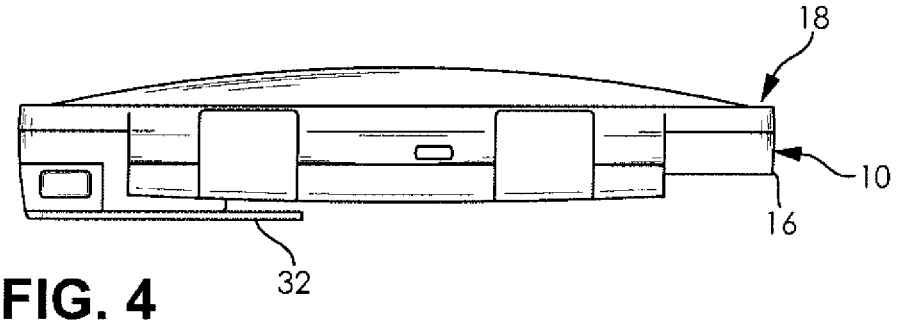
FIG. 4 is a left side elevational view of the protective cover and the portable electronic device of FIGS. 1 to 3.
Figure 5:
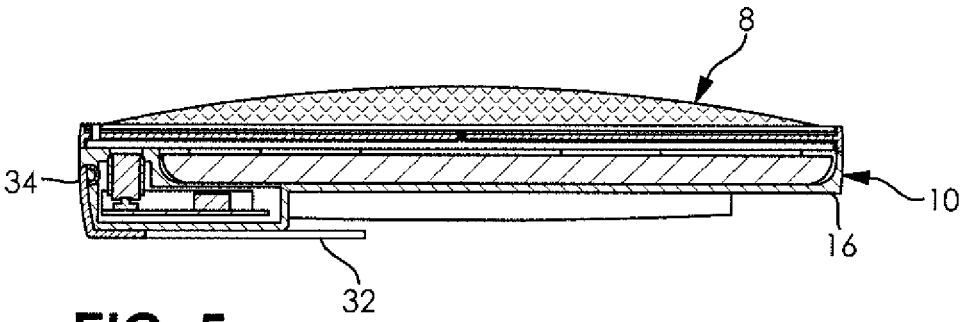
FIG. 5 is a cross-sectional view taken along line 5-5 of FIG. 2.
Figure 6:
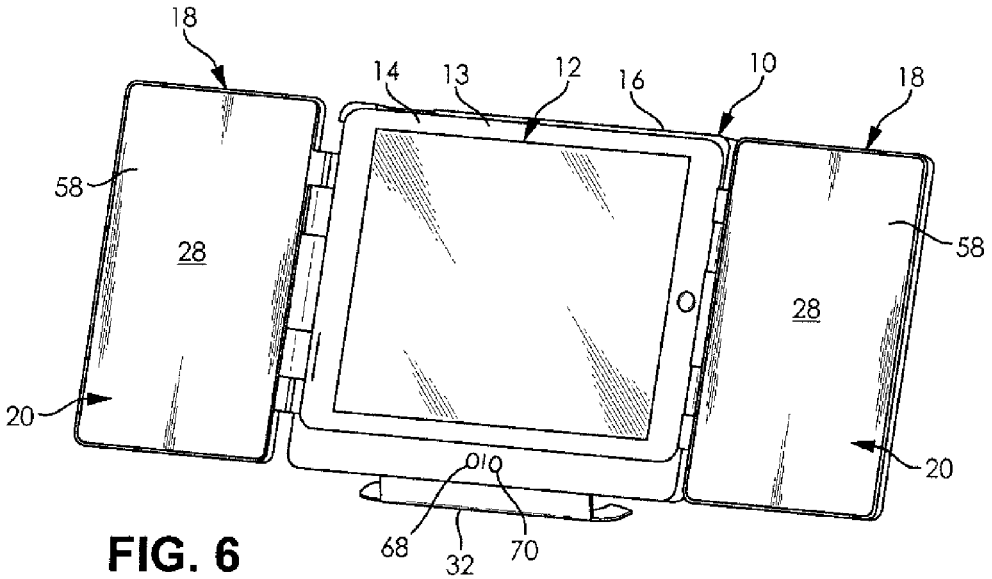
FIG. 6 is a front perspective view of the protective cover and the portable electronic device of FIGS. 1 to 5, but wherein the first and second sound panels are in a second or operational position located laterally outward beside of the electronic display screen of the portable electronic device with the flat panel loudspeakers facing forward in the same direction as the electronic display screen of the portable electronic device so that the sound panels are not covering the electronic display screen of the portable electronic device.
Figure 7:
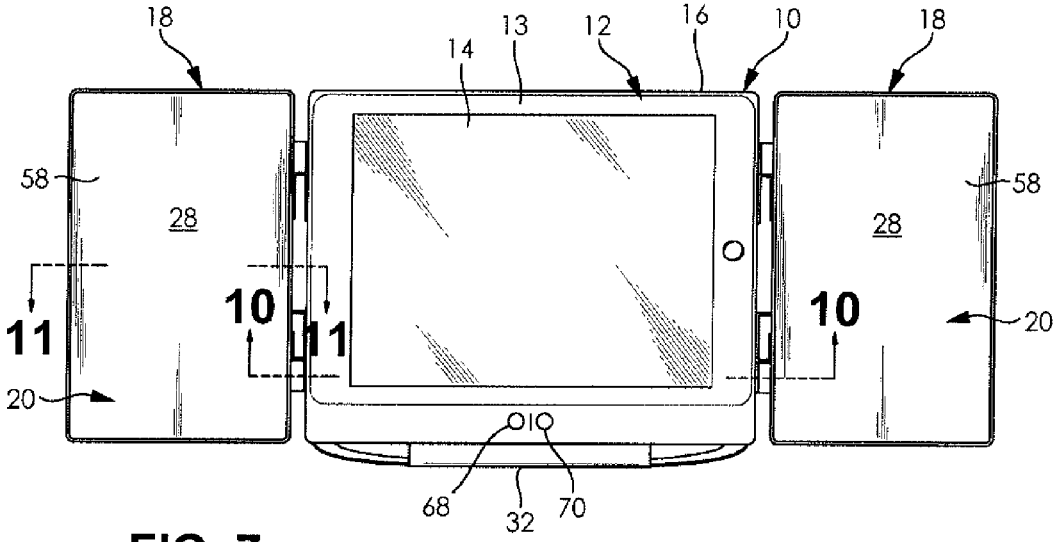
FIG. 7 is a front elevational view of the protective cover and the portable electronic device of FIG. 6.
Figure 8:
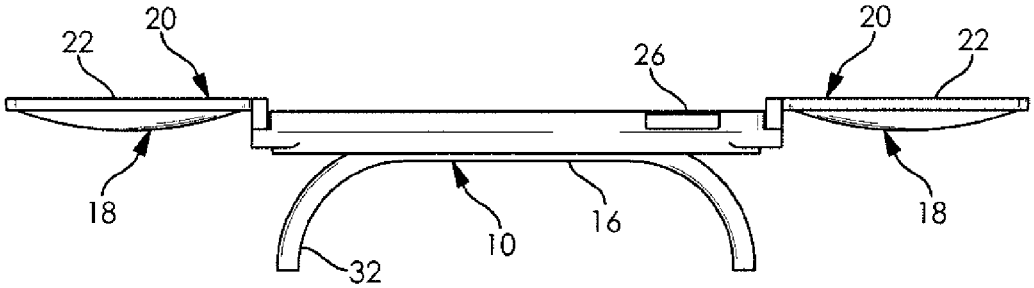
FIG. 8 is a top plan view of the protective cover and the portable electronic device of FIGS. 6 and 7.
Figure 9:
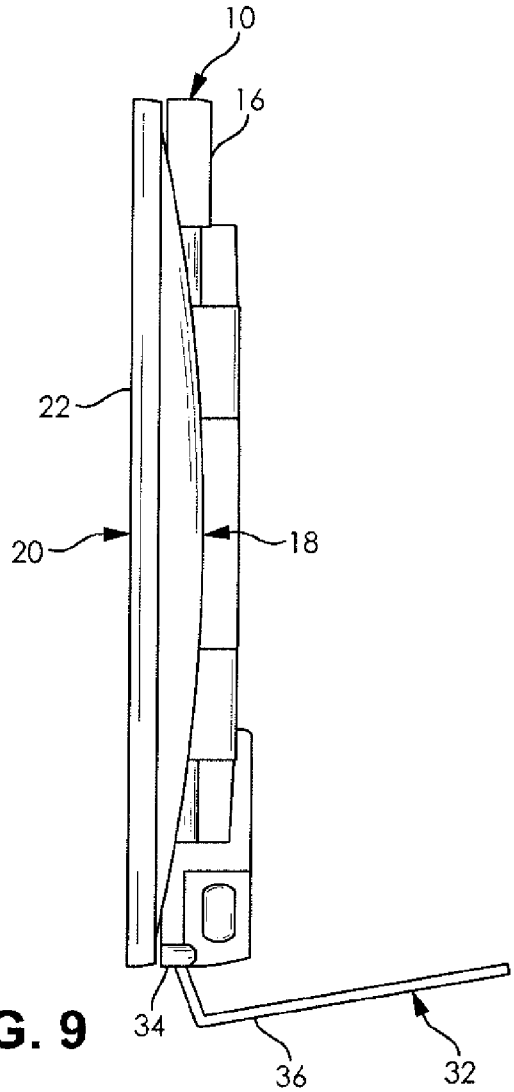
FIG. 9 is a left side elevational view of the protective cover and the portable electronic device of FIGS. 6 to 8.
Figure 10:
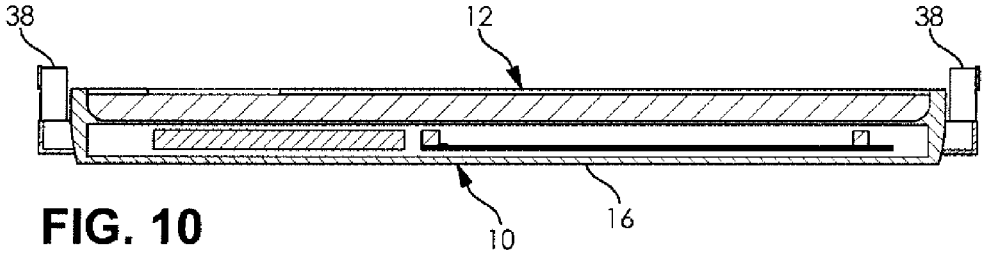
FIG. 10 is a cross-sectional view taken along line 10-10 of FIG. 7.

It should be understood that the appended drawings are not necessarily to scale, presenting a somewhat simplified representation of various preferred features illustrative of the basic principles of the invention. The specific design features of the external sound systems for portable electronic devices as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the covers for portable electronic devices illustrated in the drawings. In general, up or upward generally refers to an upward direction within the plane of the paper in FIG. 2 and down or downward generally refers to a downward direction within the plane of the paper in FIG. 2. Also in general, front or forward generally refers to a direction out of the plane of the paper in FIG. 2 and rear or rearward generally refers to a direction into the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the external sound systems for portable electronic devices disclosed herein. The following detailed discussion of various alternative and preferred embodiments will illustrate the general principles of the invention using a protective cover for a tablet computer. However, other embodiments suitable for other applications will be apparent to those skilled in the art given the benefit of this disclosure.

Referring now to the drawings, FIGS. 1 to 21 show an external sound system in the form of a protective cover or case 10 for a portable electronic device 12 according to a first embodiment of the present invention. The illustrated protective cover 10 is for use with a portable electronic device 12 having a rear surface, side surfaces, and a front surface 13 with an electronic display screen 14 in the form of a touch screen. The illustrated protective cover 10 includes a mount 16 configured to be secured to the portable electronic device 12, at least one sound or cover panel 18 coupled to the mount 16 and selectively movable relative to the mount 16 between at least first and second positions, and at least one flat panel loudspeaker 20 forming at least a portion of an exterior surface 22 of the sound panel 18 and operably coupled to the portable electronic device 12 to selectively produce audible sound from electronic signals produced by the portable electronic device 12. The illustrated mount 16 is in the form of a housing 16 configured hold the portable electronic device 12 and substantially cover each of the side surfaces and the rear surface of the portable electronic device 12. It is noted, however, that the mount 16 can alternatively have any other suitable configuration to secure the at least one sound panel 18 to the portable electronic device 12 such as a magnetic mount, a clip mount, a skeletal mount, a strap mount, a suction mount, or the like.

The illustrated portable electronic device 12 is a tablet computer in the form of an iPad available from Apple, Inc. of Cupertino, Calif. It is noted, however, that the portable electronic device 12 can alternatively be any other suitable type of tablet computer and can alternatively be any other suitable type of portable electronic device. The term "portable electronic device" is used in the specification and claims to mean a handheld electronic device that utilizes rechargeable batteries as a power source including, but not limited to, telephones, cellular phones, smart phones, personal digital assistants (PDAs), digital cameras, mp3 players, video game players, messaging systems, video players, portable televisions such as LCD televisions, tablet computers, notebook computers, laptop computers, and the like.

The illustrated housing 16 is generally rectangular-shaped has a rectangular-shaped cavity 24 formed therein with an open front side configured to closely hold the portable electronic device 12 therein with the electronic display screen 14 exposed or uncovered at the open front side. With the portable electronic device 12 within the cavity 24, the housing 16 substantially covers each of the side surfaces and the rear surface of the portable electronic device 12. The housing 16 is provided with openings 26, 28 in the form of notches to provide access to volume and power controls of the portable electronic device 12. The illustrated housing 16 is specifically configured for use with an iPad type tablet computer so it should be appreciated that it may be configured differently for other tablet computers and other types of portable electronic devices 12. The illustrated housing 16 also has an internal cavity 30 located near the bottom of the housing 16 for electronic components as is described in more detail hereinbelow. The housing 16 can be provided with any suitable type of retainer for releasably holding the portable electronic device 12 within the housing 16. The illustrated housing 16 is made of a plastic material such as for example, ABS, styrene, or the like but can alternatively be made of any other suitable material.

The illustrated housing 16 is provided with a support or stand 32 that is pivotally attached to a bottom side of the housing 16 with a hinge 34. The stand 32 is configured to support the housing 16 in an inclined position on a horizontal support surface such as a table top. The illustrated stand 32 is pivotal between a support position wherein the stand 32 is located below the housing 16 with a bottom support surface 36 of the stand 32 is facing downward (shown in FIG. 9) and a storage position wherein the stand 32 is located behind the housing 16 with the bottom support surface 36 facing rearward in the same direction as the rear of the side of the housing 16 (shown in FIG. 4). It is noted that the stand 32 can alternatively have any other suitable configuration or can alternatively be eliminated. The illustrated stand 32 is made of a lightweight metal, such as an aluminum alloy or the like, but can alternatively be formed of any other suitable material.

The illustrated protective cover 10 has two sound panels 18 but it is noted that the protective cover 10 can alternatively have one sound panel 18 or more than two sound panels 18. The illustrated first and second sound panels 18 are pivotally coupled to opposed lateral sides of the housing 16 with hinges 38 and are selectively pivotal in opposite directions relative to the housing 16 to collectively cover and uncover the front surface 13 of the portable electronic device 12 in a "barn door" like manner. The illustrated sound panels 18 are the same size so that they each cover about one-half of the front surface 13 of the portable electronic device 12 but they can alternatively be sized in any other suitable manner. The illustrated housing 16 and the illustrated sound panels 18 are provided with articulating hinges 38 therebetween. The illustrated hinges 38 have a pair of spaced-apart vertical pivot axes 39 (shown in FIG. 11) so that the sound panels 18 can selectively pivot about the respective lateral sides of the housing 16. The illustrated sound panels 18 can each selectively pivot between a first or storage position wherein the sound panels 18 are at least partially located in front of and covering the front surface 13 and electronic display screen 14 of the portable electronic device 12 with the flat panel loudspeakers 20 facing the front surface 13 and the electronic display screen 14 of the portable electronic device 12 (shown in FIGS. 1 to 4), a second or operational position, about 180 degrees from the first position, and wherein the sound panels 18 are located laterally beside the portable electronic device 12 with the flat panel loudspeakers 20 facing forward in the same direction as the front surface 13 and the electronic display screen 14 of the portable electronic device 12 (shown in FIGS. 6 to 9), and a third or additional operational position, about 360 degrees from the first position, wherein the sound panels 18 are located behind the portable electronic device 12 and the flat panel loudspeakers 20 are facing rearward in the opposite direction of the front surface 13 and the electronic display screen 14 of the portable electronic device 12 (shown in FIGS. 18 to 21). The illustrated sound panels 18 can also be infinitely positioned in any desired position between these three specifically identified positions as desired by the user. The hinges 38 are preferably provided with detents so that the sound panels 18 are held, or tend to stay, in at least these three defined positions unless enough force is provided thereto to overcome the detents. It should be noted, however, that the sound panels 18 can alternatively be coupled to the housing 16 in any other suitable manner and/or can be configured in any other suitable manner.

The illustrated protective cover 10 also has two flat panel loudspeakers 20 that are carried by the sound panels 18 and form at least a portion of exterior surfaces 22 of the sound panels 18. The illustrated first and second flat panel loudspeakers 20 are carried by the first and second sound panels 18 respectively and form substantially all of an exterior surface at one side of each of the sound panels 18 respectively. The illustrated flat panel loudspeaker 20 forms substantially the entire side surface of the sound panel 18 so that essentially the entire sound panel 18 is a compact loudspeaker 20. It is noted that alternatively each of the sound panels 18 can be provided with more than one of the flat panel loudspeakers 20. The first and second flat panel loudspeakers 20 are each operably coupled to the portable electronic device 12 to selectively produce sound as described in more detail hereinbelow. The term "flat panel loudspeaker" is used herein and in the claims to mean a loudspeaker having a substantially flat vibratable panel 54 and an exciter 56, such as an electromagnetic exciter, a piezoelectric exciter, an electrostatic exciter, or the like, coupled to the vibratable panel 54 to selectively impart vibrations on the vibratable panel 54 based on electronic signals from the portable electronic device 12 to produce desired audible sounds from the portable electronic device 12.

Figure 11:
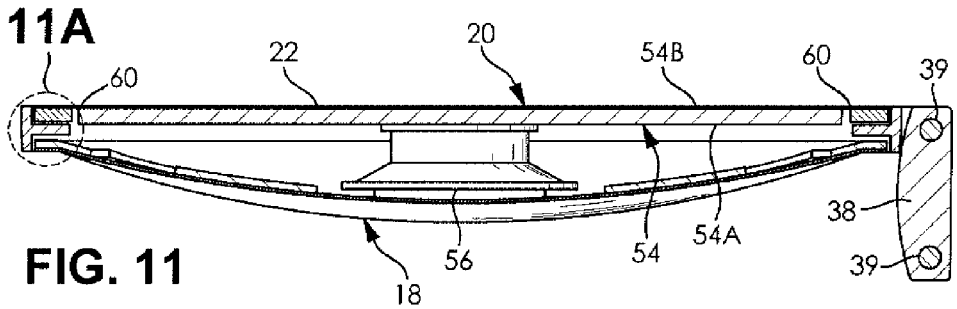
FIG. 11 is a cross-sectional view taken along line 11-11 of FIG. 7.
Figure 12:
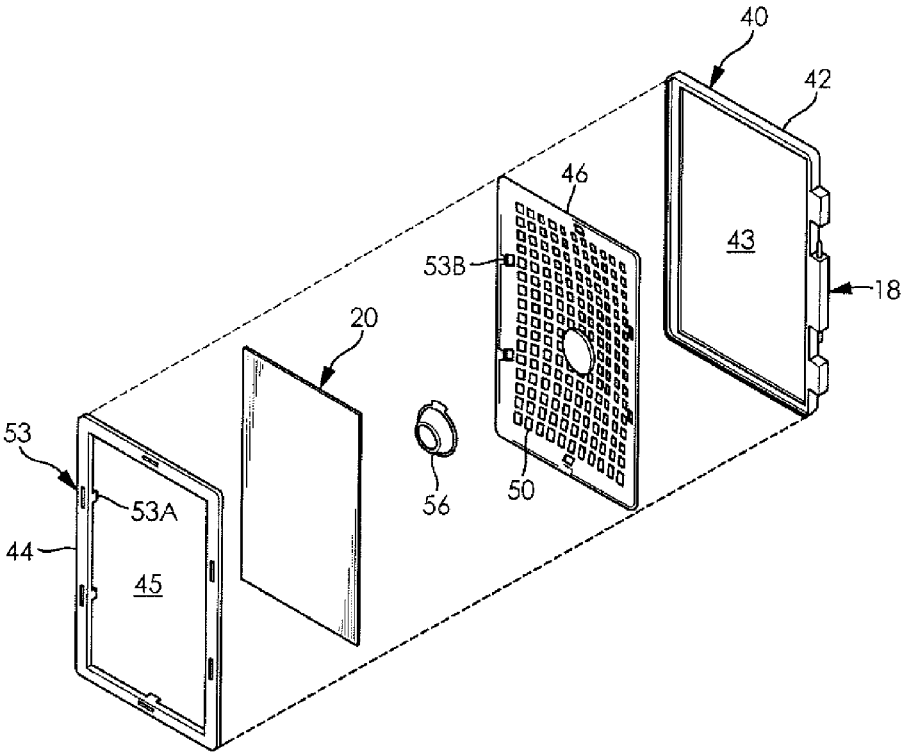
FIG. 12 is an exploded front perspective view of the first sound panel of the protective cover of FIGS. 6 to 11, wherein some components are removed for clarity.
Figure 13:
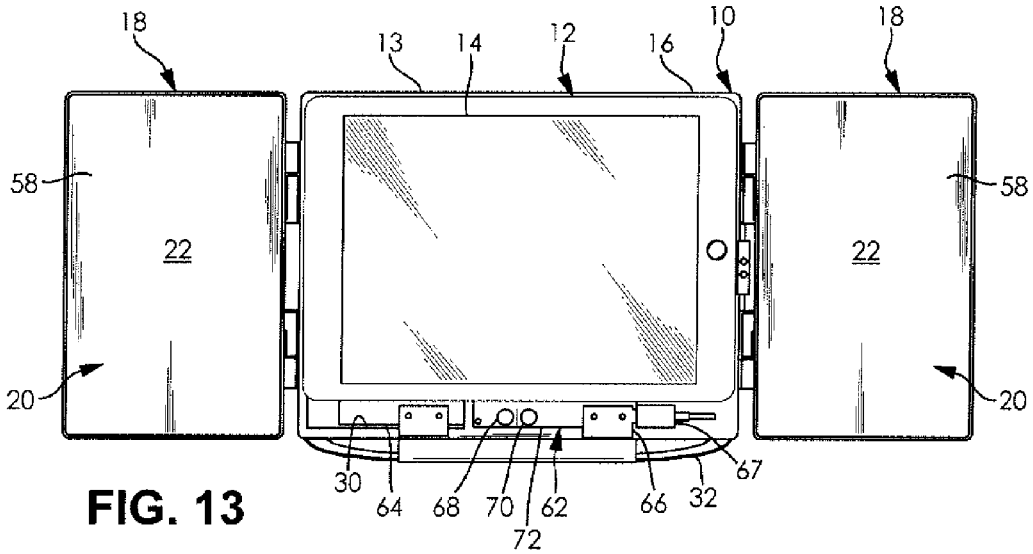
FIG. 13 is a front elevational view of the protective cover and the portable electronic device similar to FIG. 7, but wherein a housing of the protective cover is partially transparent to show internal electrical components of the protective cover of FIGS. 6 to 12.
Figure 14:
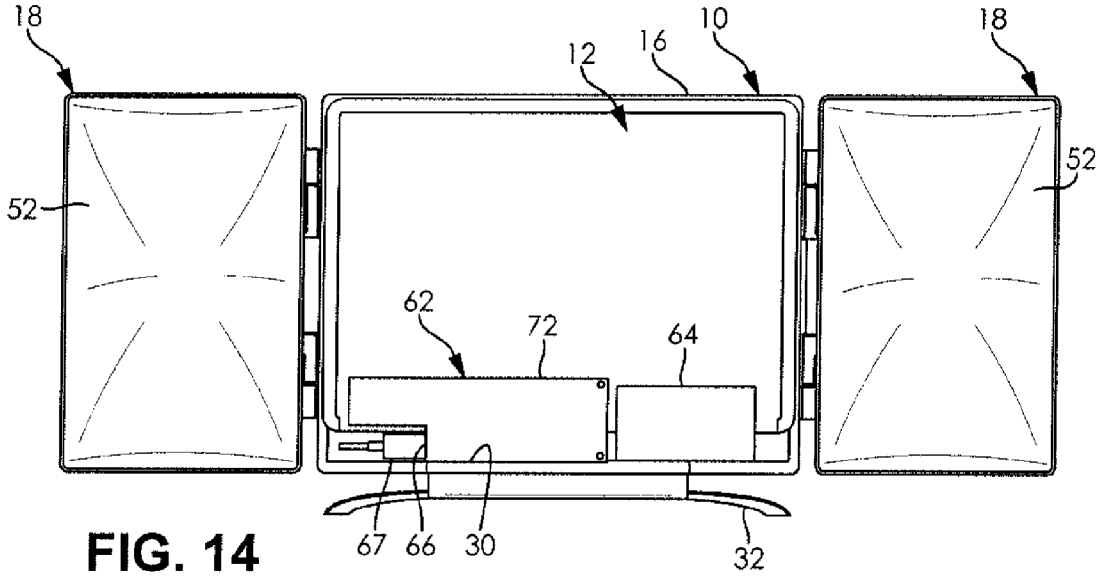
FIG. 14 is a rear elevational view of the protective cover and the portable electronic device similar to FIG. 7 but wherein the housing of the protective cover is partially transparent to show internal electrical components of the protective cover of FIGS. 6 to 13.
Figure 15:
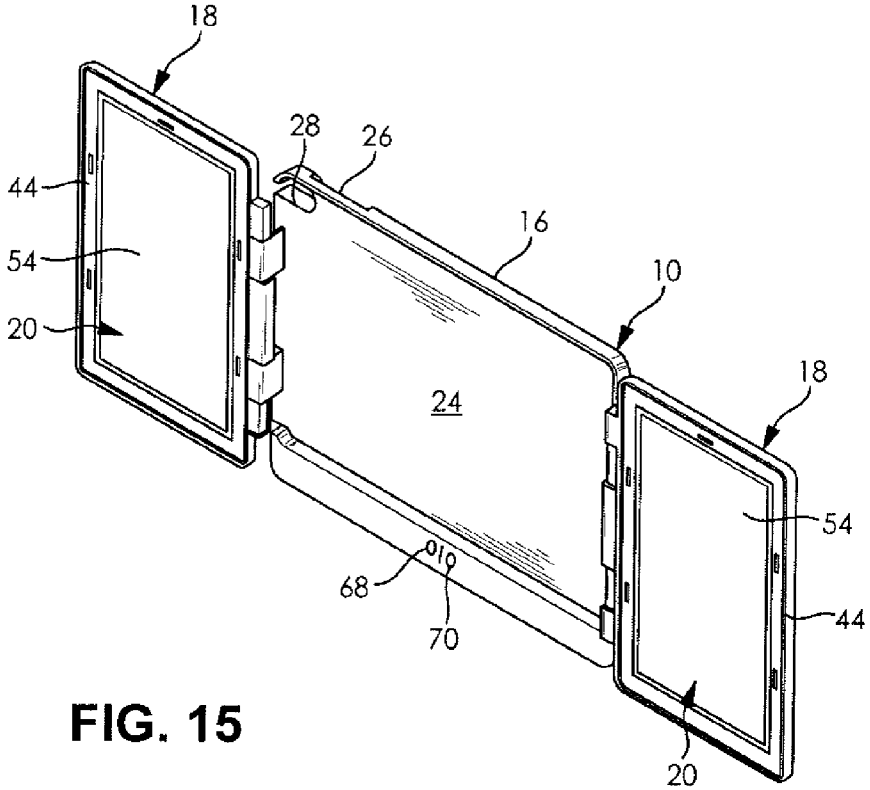
FIG. 15 is a front perspective view similar to FIG. 6, but wherein the portable electronic device and the cover sheets of the flat panel loudspeakers are removed for clarity.
Figure 16:
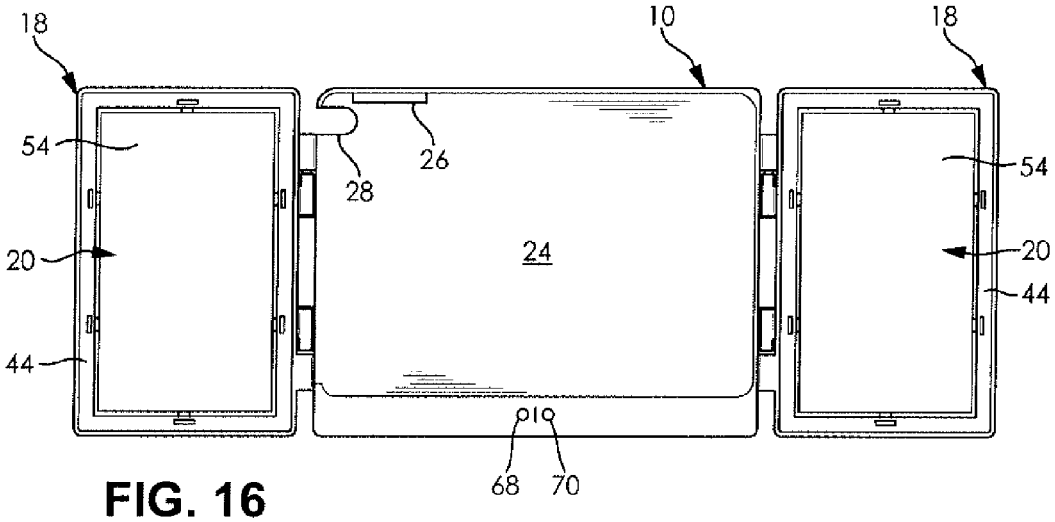
FIG. 16 is a front elevational view similar to FIG. 7, but wherein the portable electronic device and the cover sheets of the flat panel loudspeakers are removed for clarity.
Figure 17:
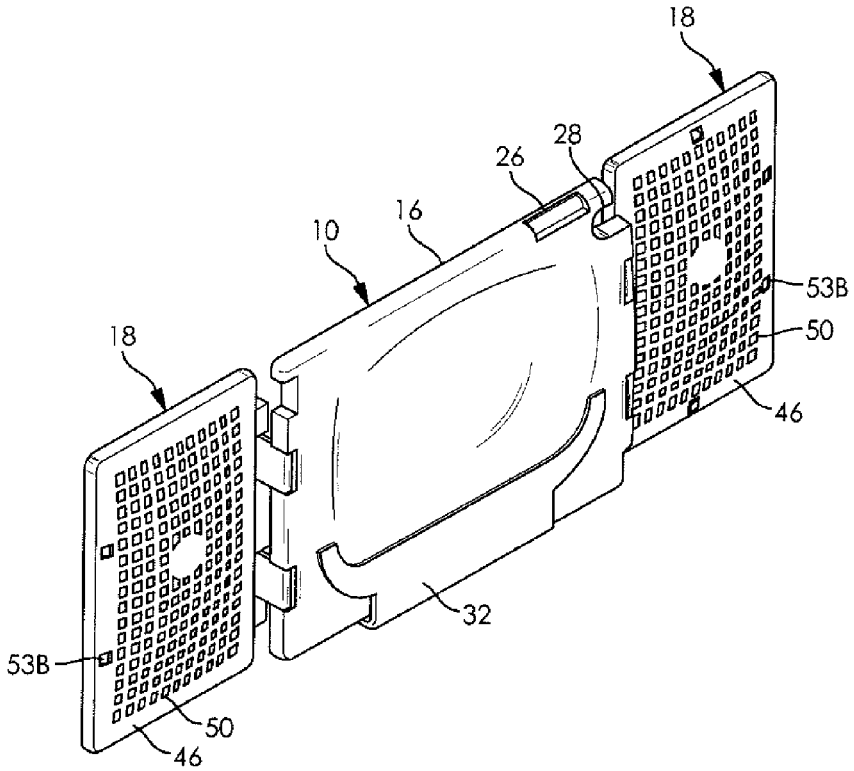
FIG. 17 is a rear perspective view of the protective cover of FIGS. 15 and 16, wherein coversheets of the sound panel removed for clarity.
Figure 18:
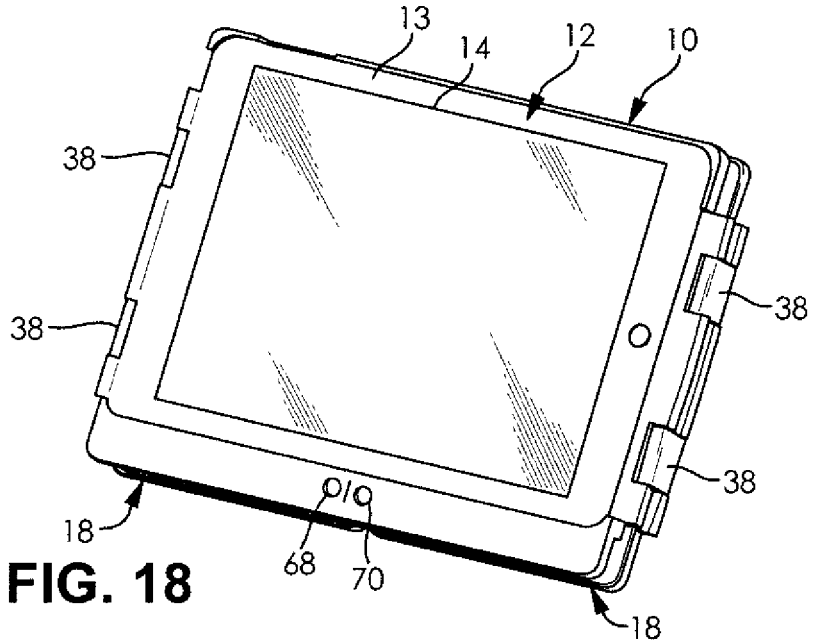
FIG. 18 is a front perspective view of the protective cover and the portable electronic device of FIGS. 1 to 17, but wherein the first and second sound panels are in a third or additional operational position located behind the electronic display screen of the portable electronic device with the flat panel loudspeakers facing rearward opposite the direction of the electronic display screen of the portable electronic device so that the sound panels are not covering the electronic display screen of the portable electronic device.
Figure 19:
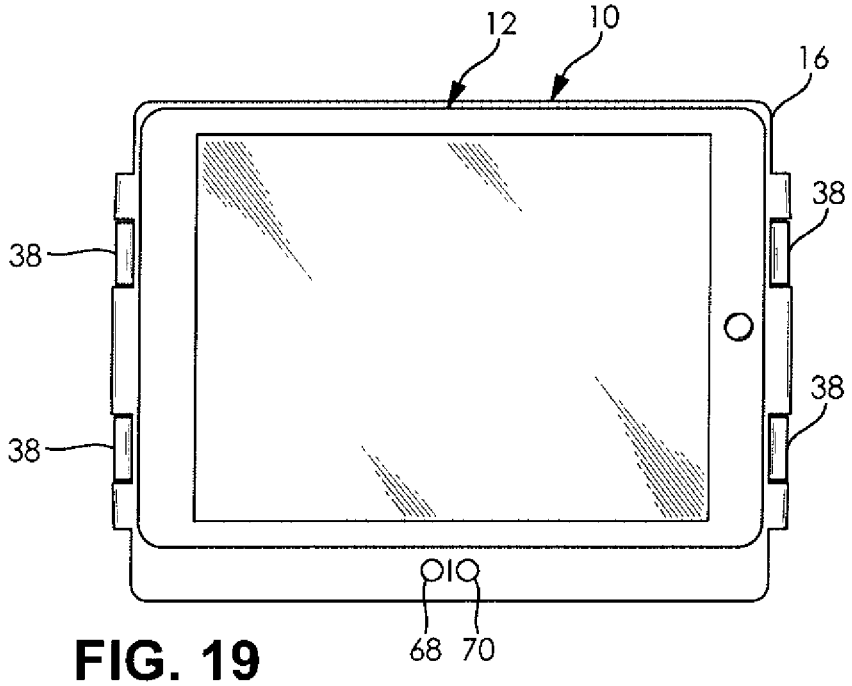
FIG. 19 is a front elevational view of the protective cover and the portable electronic device of FIG. 18.
Figure 20:
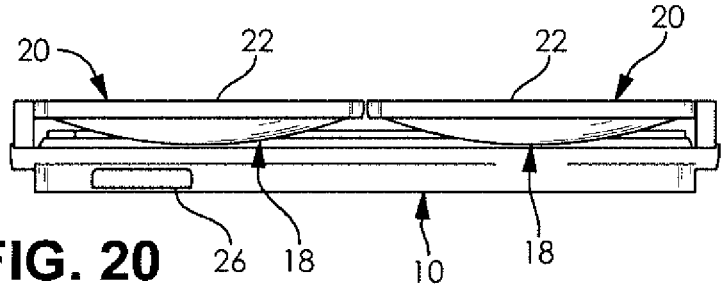
FIG. 20 is a top plan view of the protective cover and the portable electronic device of FIGS. 18 and 19.
Figure 21:
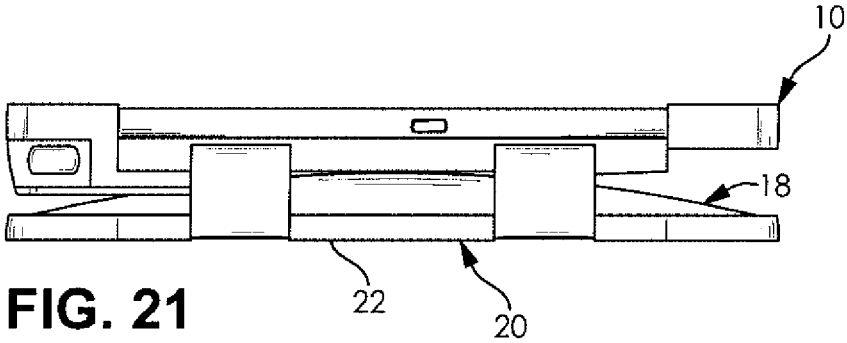
FIG. 21 a left side elevational view of the protective cover and the portable electronic device of FIGS. 18 to 20.

As best shown in FIGS. 11 and 12, the illustrated sound panels 18 each include a frame 40. The illustrated frame 40 has a first frame member 42, a second frame member 44, and a rear enclosure 46. The illustrated first frame member 42 is generally rectangular shaped with a central opening 43 so that it encircles the flat panel loudspeaker 20 as described in more detail hereinbelow. The first frame member 42 includes a portion of the hinges 38 for pivotal connection to the housing 16. The illustrated first frame member 42 also has a flange 48 forming opposed outward and inward facing and inward extending abutments (48A, 48B encircling the flat panel loudspeaker 20. The illustrated first frame member 42 is made of a lightweight metal, such as an aluminum alloy, but can alternatively be formed of any other suitable material.

The illustrated second frame member 44 is also rectangular shaped with a central opening 45 so that it encircles the flat panel loudspeaker 20 and is secured to the first frame member 42. The illustrated second frame member 44 is secured to the first frame member 42 and cooperates with the flat panel loudspeaker 20 as described in more detail hereinbelow. The illustrated second frame 44 member is made of a plastic material but can alternatively be formed of any other suitable material.

The illustrated rear enclosure 46 has a plurality of openings 50 and is secured to the first frame member 42 to generally close the opening 43 in the first frame member 42 at a rear side of the sound panel 18. The openings 50 are sized to enable air to enter and exit the interior of the sound panel 18 between the rear enclosure 46 and the vibratable panel 54, so that entrapment of air does not impede movement of the vibratable panel 54 of the flat panel loudspeaker 20. A breathable cover sheet 52 is secured to an outer side of the rear enclosure 46, such as by adhesive or the like, and covers the entire rear side of the rear enclosure 46. The breathable cover sheet 52 can be any suitable type of fabric or the like that suitable permits the passage of air therethrough. A suitable fabric is a microfiber polyester fabric.

The illustrated second frame member 44 is secured directly to the rear enclosure 46 to clamp the second frame member 44 and the rear enclosure 46 to the flange 48 of the first frame member 42. The illustrated second frame member 44 and the rear enclosure 46 are provided with snap-lock fasteners 53 but any other suitable kind of connection can alternatively be utilized. The illustrated snap lock fasteners 53 include resilient legs 53A that resiliently snap into openings 53 B in the rear enclosure 46 to lock the second frame member 44 and the rear enclosure 46 together but it is noted that the snap lock fasteners 53 can alternatively have any other suitable configuration. It is also noted that the second frame member 44 and the rear enclosure 46 can alternatively be secured to the first frame member 42 in any other suitable manner. The illustrated rear enclosure 46 has a convex or dome-like exterior surface, opposite the flat panel loudspeaker 20, which both provides adequate space for the exciter 56 and protects the exciter 56 by deflecting objects impacting the rear enclosure 46 away from the exciter 56. The illustrated rear enclosure 46 is made of a plastic material but can alternatively be formed of any other suitable material.

The illustrated flat panel loudspeakers 20 each include a substantially flat vibratable panel 54 having substantially planar inner and outer surfaces 54A, 54B, an exciter 56 secured to the frame 40 to substantially prevent movement therebetween and secured to the inner surface of the vibratable panel 54 to selectively impart vibrations to the vibratable panel 54, and a flexible support or cover sheet 58 secured to the outer surface of the vibratable panel 54, such as by adhesive, and coupled to the frame 40 to partially support the vibratable panel 54 while permitting vibrational movement of the vibratable panel 54 relative to the frame 40. The illustrated vibratable panel 54 is rectangular-shaped to cooperate with the illustrated sound panels 18 but any other suitable shape can alternatively be utilized. The illustrated vibratable panel 54 includes a honeycomb core sandwiched between two substantially planar face sheets forming the inner and outer surfaces 54A, 54B so that it is lightweight and rigid in the x-y plane but any other suitable materials or configuration can alternatively be utilized.

The exciter 56 can be of any suitable type such as, for example, an electromagnetic exciter, a piezoelectric exciter, an electrostatic exciter, or the like, and is located between the rear enclosure 46 and the vibratable panel 54. The illustrated exciter 56 is secured to the inside of the rear enclosure 46 in any suitable manner such as by adhesive or the like. The illustrated exciter 56 is an electromagnetic exciter and is also secured to the inner surface 54A of the vibratable panel 54 in any suitable manner such as by adhesive or the like. Other types of exciters 56 may be coupled to the vibratable panel 54 in any suitable manner. The illustrated rear enclosure 46 preferably has enough rigidity so that operation of the exciter 56 moves the vibratable panel 54 to produce desired sound but substantially does not move the rear enclosure 46.

Figure 11A:
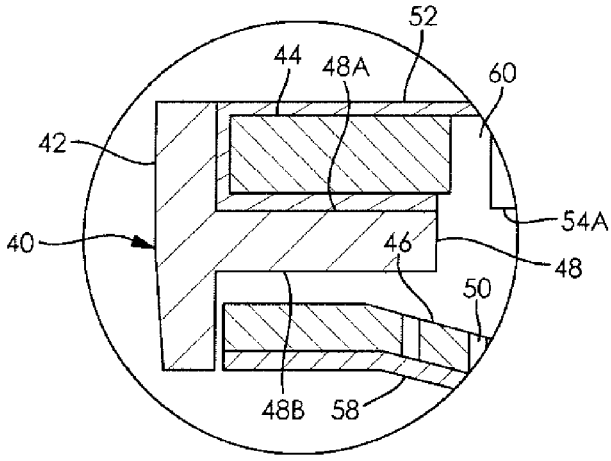
FIG. 11A is an enlarged fragmented view taken along line 11A-11A of FIG. 11.

The illustrated flexible support or cover sheet 58 is secured to the outer surface 54B of the vibratable panel 54 in any suitable manner such as adhesive and is coupled to the frame 40 to partially support the vibratable panel 54 along with the exciter 56. The illustrated flexible support sheet 58 is coupled to the frame 40 by being partially wrapped around the second frame member 44 so that it is clamped between the second frame member 44 and the first frame element 42 around the entire periphery of the vibratable panel 54. The illustrated flexible support sheet 58 extends across the outer side of the second frame element 44, around the lateral outer end, and back toward the vibratable panel 54 across the inner side of the second frame member 44 between the second frame member 44 and the flange 48 of the first frame element 43 (shown in FIG. 11A). The illustrated flexible support sheet 58 extends across a gap 60 between the vibratable panel 54 and the second frame member 44 which permits movement of the vibratable panel 54 relative to the second frame member 44. The illustrated flexible support sheet 58 also entirely closes the opening in the first frame member 42 at the front side of the sound panel 18 so that the entire front side of the sound panel 18 is substantially flat or planar. Configured in this manner, the vibratable panel 54 is supported only by the exciter 56 and the flexible support sheet 58. It is noted that the flexible support sheet 58 can be additionally secured to the second frame member 44 by an adhesive or the like. It is also noted that the flexible support sheet 58 can alternatively be secured to the frame 40 in any other suitable manner.

The illustrated flexible sheet 58 is a woven or nonwoven fabric but any other suitable material can alternatively be utilized. The flexible support sheet 58 is preferably lightweight and stretchable and preferably has a low density. A suitable fabric is a microfiber polyester fabric. It is noted that rubbery or dense fabrics tend to deaden the sound and open or lightweight weaves produce the best sound. The flexible support sheet 58 is preferably a suitable material for engaging the electronic display screen 14 of the portable electronic device 12 without causing damage thereto when sound panels 18 are in the first position covering the electronic display screen 14 of the portable electronic device 12.

The illustrated protective cover 10 is provided with a controller 62, a rechargeable battery 64 in electrical connection with the controller 62, an input port 66 in electrical communication with the controller 62, and user input controls 68, 70 in electrical connection with the controller 62. The rechargeable battery 64 is located within the cavity 30 of the housing 16 and can be of any suitable type. The controller 62 has a suitable processor and memory and is programmed to receive electronic signals representing sound from the portable electronic device 12, enhance the signals, and to send the enhanced signals to the flat panel loudspeakers 20. The illustrated controller 62 is configured to process the electronic signals from the portable electronic device 12 to improve the sound quality but alternatively this function can be eliminated. The illustrated controller 62 includes a circuit board 72 with components secured thereto and located within the cavity 30 of the housing 16 next to the rechargeable battery 64. The illustrated controller 62 is wirelessly connected to the portable electronic device 12 to receive the electronic signals but alternatively can be provided with a wired connection. The wireless connection utilizes Bluetooth but the wireless connection can alternatively be of any other suitable type. The illustrated controller 62 is also electrically connected to the flat panel loudspeaker 20 with wires extending through the hinges 38 to send power and the electronic signals to produce the desired audible sound. It is noted that alternatively the controller 62 can wirelessly connected to the flat panel loudspeaker 20 but a separate battery may be required at the flat panel loudspeaker 20. The illustrated input port 66 is a USB port but any other suitable type of input port can alternatively be utilized. The USB port can be utilized to recharge the battery 64 and/or to communicate with the controller 62. The illustrated USB port is shown with a USB cable 67 inserted therein. The illustrated user input devices 68, 70 include a pair of push buttons. The first push button 68 is a power on/off button to selectively provide power from the battery 64 to the controller 62. The second push button 70 is a pair button to selectively pair the wireless connection between the portable electronic device 12 and the controller 62. The illustrated push buttons 68, 70 are located at the front of the housing 16 below the portable electronic device 12. It is noted that the user input devices 68, 70 can alternatively be of any other suitable type or located at any other suitable location.

Figure 22:
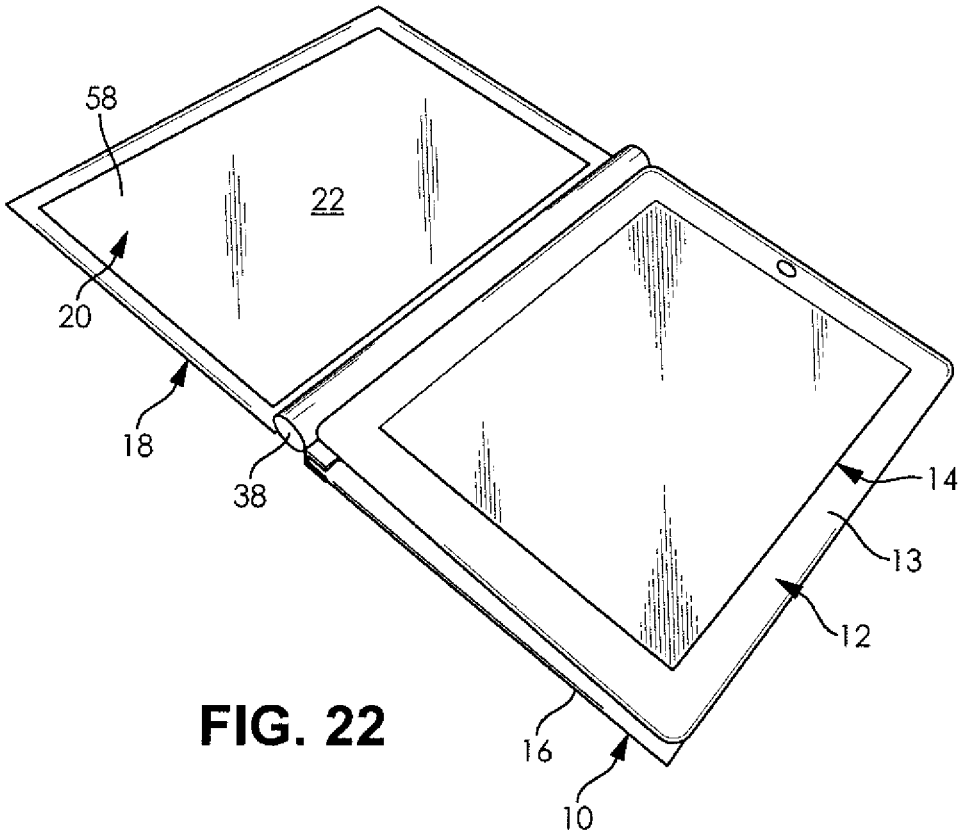
FIG. 22 is a front perspective view of a protective cover on a portable electronic device according to a second embodiment of the present invention, wherein a single sound panel is in a second or operational position located laterally outward beside of the electronic display screen of the portable electronic device with the flat panel loudspeaker facing forward in the same direction as the electronic display screen of the portable electronic device so that the sound panel is not covering the electronic display screen of the portable electronic device.
Figure 23:
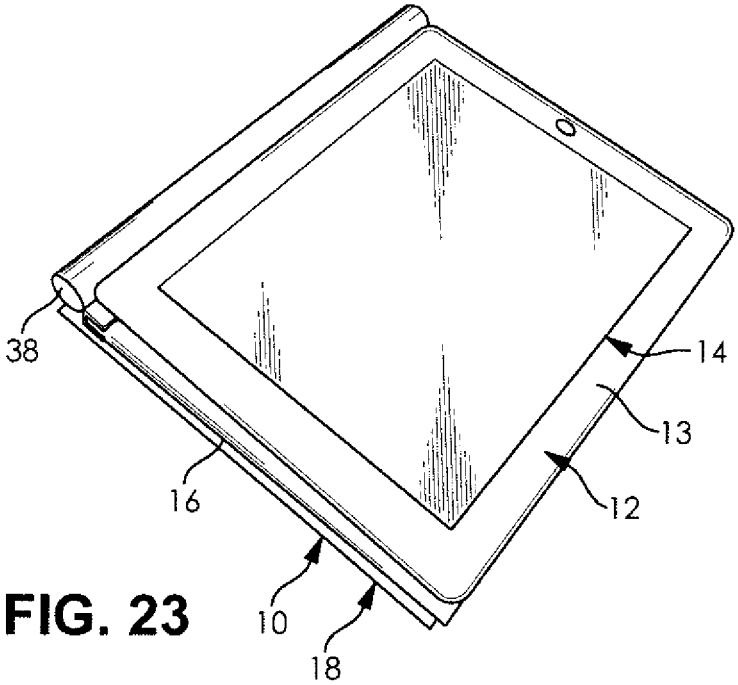
FIG. 23 is a front perspective view of the protective cover on the portable electronic device of FIG. 22, wherein the sound panel is in a third or additional operational position located behind the electronic display screen of the portable electronic device with the flat panel loudspeakers facing rearward opposite the direction of the electronic display screen of the portable electronic device so that the sound panels are not covering the electronic display screen of the portable electronic device.

FIGS. 22 and 23 show a protective cover or case 10 for a portable electronic device 12 according to a second embodiment of the present invention. The illustrated protective cover 10 is substantially the same as the first embodiment described above except that a single sound panel 18 is utilized that has one or more flat panel loudspeakers 20. Such a single sound panel 18 configuration can be useful with relatively small portable electronic devices 12 such as small tablet computers like iPad minis and smart phones like iPhones.

Any of the features or attributes of the above described embodiments and variations can be used in combination with any of the other features and attributes of the above described embodiments and variations as desired.

It is apparent from the above detailed description of preferred embodiments of the present invention, that the external sound systems according to the present invention provide much improved sound without substantially increasing the size, weight, or bulkiness of the portable electronic device 12. It is also apparent that the external sound systems according to the present invention provide integrated flat panel loudspeakers 20 that essentially blend with the protective cover or other mount 16 so that they are compact and do not degrade the aesthetics or portability of the portable electronic device 12. It is also apparent that the disclosed sound systems 10 provide sound panels 18 that double as a protective covers for the electronic displays screens 14 and flat panel loud speakers 20 for the portable electronic devices 12.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An external sound system for a portable electronic device having an electronic display screen, said external sound system comprising, in combination:

a mount configured to be secured to the portable electronic device;

at least one sound panel coupled to the mount and selectively movable relative to the mount between at least a first position and a second position;

at least one flat panel loudspeaker forming at least a portion of an exterior surface of the sound panel and operably coupled to the portable electronic device to selectively produce sound;

wherein the at least one sound panel is configured so that the at least one flat panel loudspeaker faces and at least partially covers the electronic display screen of the portable electronic device to protect the electronic display screen of the portable electronic device when the sound panel is in the first position and so that the at least one flat panel loudspeaker is located laterally beside the electronic display screen of the portable electronic device and faces in the same direction as the electronic display screen of the portable electronic device when the sound panel is in the second position; and wherein the sound panel includes a frame and the at least one flat panel loudspeaker includes a vibratable panel having inner and outer surfaces, an exciter fixed to the frame and secured to the inner surface of the vibratable panel to selectively impart vibrations to the vibratable panel, and a flexible support sheet secured to the outer surface of the vibratable panel and coupled to the frame to partially support the vibratable panel.

2. The external sound system according to claim 1, wherein there are two of the sound panels, there are two of the flat panel loudspeakers, a first one of the two flat panel loudspeakers forms at least a portion of an exterior surface of a first one of the two sound panels, and a second one of the two flat panel loudspeakers forms at least a portion of an exterior surface of a second one of the two sound panels.

3. The external sound system according to claim 2, wherein the first and second sound panels are pivotally secured to the mount on opposed sides of the portable electronic device and pivot in opposite directions between the first position and the second position.

4. The external sound system according to claim 1, wherein the frame has a first frame member and a second frame member, the first frame member is coupled to the mount and encircles the vibratable panel, the second frame member encircles the vibratable panel is secured to the first frame member with the flexible support sheet at least partially wrapped around the second frame member to secure the flexible support sheet to the frame.

5. The external sound system according to claim 4, wherein the flexible support sheet is fabric.

6. The external sound system according to claim 5, wherein the sound panel further includes a rear enclosure having a plurality of openings and secured to the first frame member, the rear enclosure is located behind the vibratable panel with the exciter between the vibratable panel and the rear enclosure and the exciter secured to the rear enclosure, and wherein the sound panel includes a breathable sheet covering the rear enclosure.

7. The external sound system according to claim 6, wherein the breathable sheet is fabric.

8. The external sound system according to claim 6, wherein the first frame member has a flange forming opposed outward and inward facing abutments encircling the vibratable panel, and wherein the second frame member is secured directly to the rear enclosure to clamp the second frame member and the rear enclosure to the flange of the first frame member.

9. The external sound system according to claim 1, wherein the sound panel is pivotally secured to the mount and selectively pivotal between the first position, the second position about 180 degrees from the first position, and a third position about 360 degrees from the first position and behind the portable electronic device with the flat panel loudspeaker facing in a direction opposite of the electronic display screen of the portable electronic device.

10. An external sound system for a portable electronic device having an electronic display screen, said external sound system comprising, in combination:

a housing configured to hold the portable electronic device;

at least one sound panel coupled to the housing and selectively movable relative to the housing to between at least a first position and a second position;

at least one flat panel loudspeaker forming at least a portion of an exterior surface of the at least one sound panel and operably coupled to the portable electronic device to selectively produce sound;

wherein the at least one sound panel is configured so that the at least one flat panel loudspeaker faces and at least partially covers the electronic display screen of the portable electronic device to protect the electronic display screen of the portable electronic device when the sound panel is in the first position and so that the at least one flat panel loudspeaker is located laterally beside the electronic display screen of the portable electronic and faces in the same direction as the electronic display screen of the portable electronic device when the sound panel is in the second position; and wherein the sound panel includes a frame and the at least one flat panel loudspeaker includes a vibratable panel having inner and outer surfaces, an exciter fixed to the frame and secured to the inner surface of the vibratable panel to impart vibrations to the vibratable panel, and a flexible support sheet secured to the outer surface of the vibratable panel and coupled to the frame to partially support the vibratable panel.

11. The external sound system according to claim 10, wherein there are two of the sound panels, there are two of the flat panel loudspeakers, a first one of the two flat panel loudspeakers forms at least a portion of an exterior surface of a first one of the two sound panels, and a second one of the two flat panel loudspeakers forms at least a portion of an exterior surface of a second one of the two sound panels.

12. The external sound system according to claim 11, wherein the first and second sound panels are pivotally secured to the housing on opposed sides of the housing and pivot in opposite directions between the first position and the second position.

13. The external sound system according to claim 10, wherein the frame has a first frame member and a second frame member, the first frame member is coupled to the housing and encircles the vibratable panel, the second frame member encircles the vibratable panel is secured to the first frame member with the flexible support sheet at least partially wrapped around the second frame member to secure the flexible support sheet to the frame.

14. The external sound system according to claim 13, wherein the flexible support sheet is fabric.

15. The external sound system according to claim 13, wherein the sound panel further includes a rear enclosure having a plurality of openings and secured to the first frame member, the rear enclosure is located behind the vibratable panel with the exciter between the vibratable panel and the rear enclosure and the exciter secured to the rear enclosure, and wherein the sound panel includes a breathable sheet covering the rear enclosure.

16. The external sound system according to claim 15, wherein the breathable sheet is fabric.

17. The external sound system according to claim 15, wherein the first frame member has a flange forming opposed outward and inward facing abutments encircling the vibratable panel, and wherein the second frame member is secured directly to the rear enclosure to clamp the second frame member and the rear enclosure to the flange of the first frame member.

18. A protective cover for a portable electronic device having an electronic display screen, said protective cover comprising, in combination:

a housing configured to hold the portable electronic device;

first and second sound panels pivotally coupled to the housing on opposed sides of the housing and selectively pivotal in opposite directions relative to the housing to cover and uncover the electronic display screen of the portable electronic device;

a first flat panel loudspeaker forming at least a portion of an exterior surface of the first sound panel and operably coupled to the portable electronic device to selectively produce sound and a second flat panel loudspeaker forming at least a portion of an exterior surface of the second sound panel and operably coupled to the portable electronic device to selectively produce sound; and wherein the first and second sound panels each include a frame and the first and second flat panel loudspeakers each include a vibratable panel having inner and outer surfaces, an exciter fixed to the frame and secured to the inner surface of the vibratable panel to impart vibrations to the vibratable panel, and a flexible support sheet secured to the outer surface of the vibratable panel and coupled to the frame to partially support the vibratable panel.

* * * * *